United States Patent [19]

Bianchi et al.

[11] 4,225,067

[45] Sep. 30, 1980

[54] HOLSTER WITH CONTROLLABLE RESISTANCE TO DRAW

[75] Inventors: John E. Bianchi; Richard D. E. Nichols, Fallbrook, both of Calif.

[73] Assignee: Bianchi Leather Products, Inc., Temecula, Calif.

[21] Appl. No.: 11,419

[22] Filed: Feb. 12, 1979

[51] Int. Cl.[3] ..... A41F 00/00

[52] U.S. Cl. ..... 224/243; 224/231

[58] Field of Search ..... 224/243, 244, 198, 191, 224/192, 231

[56] References Cited

U.S. PATENT DOCUMENTS

| | | | |
|---|---|---|---|
| 1,295,831 | 3/1919 | Alderson | 224/231 X |
| 1,547,800 | 7/1925 | Franz | 224/243 |
| 1,629,700 | 5/1927 | Harter | 224/231 X |
| 2,088,811 | 8/1937 | Ray | 224/243 |
| 2,577,869 | 12/1951 | Adams | 224/243 X |
| 3,197,098 | 7/1965 | Clark | 224/231 |
| 3,630,420 | 12/1971 | Bianchi | 224/243 X |
| 3,902,639 | 9/1975 | Rogers | 224/231 X |

*Primary Examiner*—Steven M. Pollard

*Attorney, Agent, or Firm*—John E. Wagner

[57] ABSTRACT

A holster employing a holster body and a liner which cooperatively define a weapon pocket and including a metal reinforcement between the liner and the body which at least partially defines the shape of a handgun carrying cavity. Secured to the reinforcement is a leaf spring having a free length extending on the side of the reinforcement toward the handgun cavity. A controllable extension device such as a screw engaging the free end of the spring causes a controlled deflection of the spring into the handgun cavity a distance which is a function of the screw position. The liner covers the spring member whereby the spring serves to expand the liner inward against the side of the handgun applying direct frictional contact with the handgun to the extent desired by the user and controllable merely by tightening or loosening the screw.

12 Claims, 12 Drawing Figures

FIG. 1
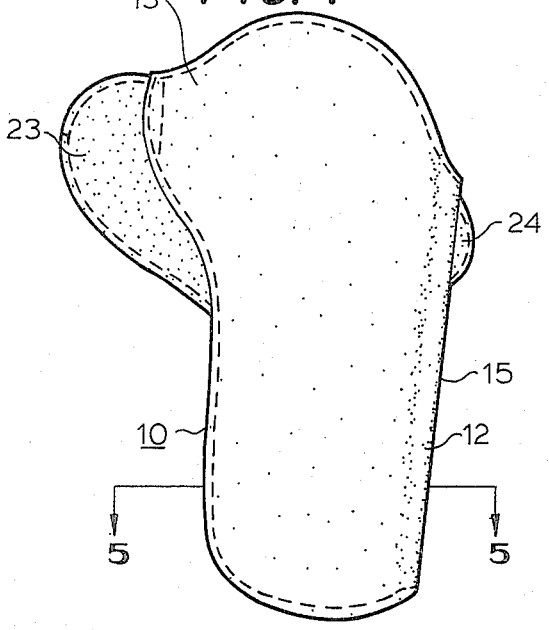
FIG. 2
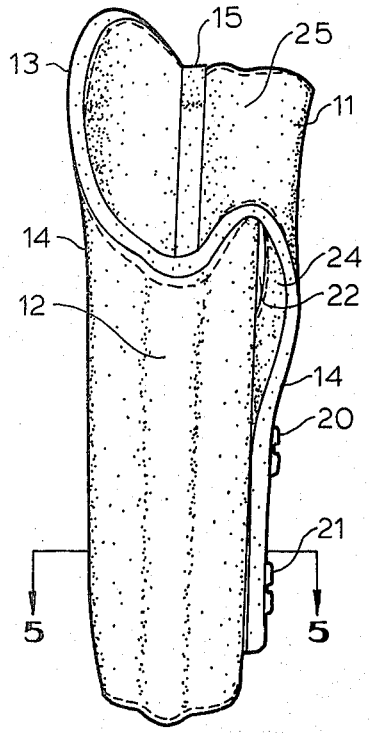
FIG. 5
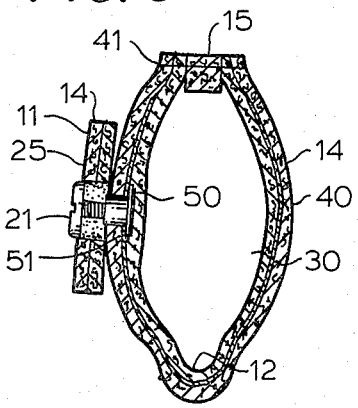
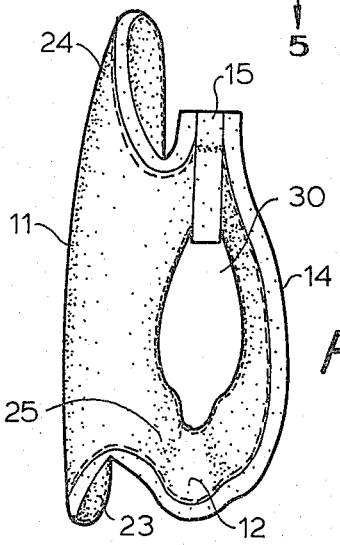
FIG. 3
FIG. 6
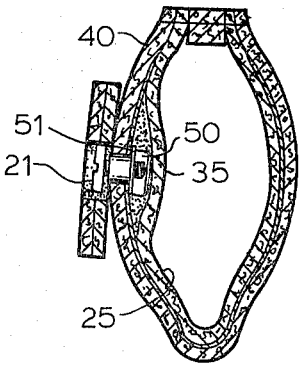
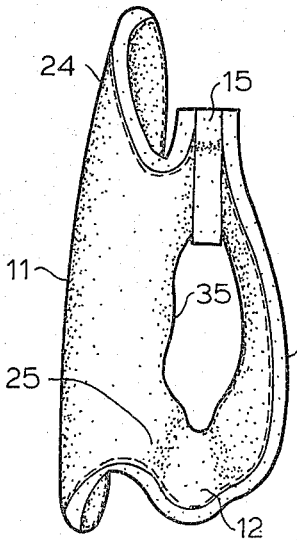
FIG. 4

HOLSTER WITH CONTROLLABLE RESISTANCE TO DRAW

BACKGROUND OF THE INVENTION

Through the years with the development of holsters for handguns, a trend has developed toward the holster which is carefully fitted to each particular handgun and barrel length to provide a truly effective carrying device for the handgun. In former years, a pouch of sufficient size to hold the handgun combined with some kind of cover or restraint was considered satisfactory. That is no longer the case. Recent developments in the refinement of holsters are illustrated in our U.S. Pat. Nos. 3,977,583 and 3,960,460 and 4,035,902, each of which illustrate the continuing development of precise controlled shaped holsters.

In the case of open top holsters and particularly those designed for competition use, there has been a further need for restrainers to keep the handgun within the holster while allowing rapid and precise drawing. Our co-pending application, Ser. No. 11,420 filed Feb. 12, 1979 illustrates an effective solution to this need. It employs a finger supported on a flexible spring which engages the trigger guard opening to hold a handgun in place and prevent its falling out when the wearer undergoes strenuous activities, such as in combat competition.

The use of a restraining finger extending into a finger guard requires that each assembly be configured for each particular weapon and when so designed, is basically fixed for that particular holster and weapon.

We have found that shooters often like to control the restraint upon drawing of a handgun from various types of holsters, not merely competition holsters and as the holster wears in, desire to make adjustments in the resistance to drawing. Other shooters desire to have only leather in contact with their handgun to avoid abrading friction wear on bluing and metal surfaces.

BRIEF DESCRIPTION OF THE INVENTION

Given the foregoing state of the art and needs, we have faced the problem and discovered that a relatively simple mechanism can be combined with a reinforced holster to give controllable resistance to drawing through a simple screw adjustment and one which may be made by the user with the screw driver. The resistance to drawing is repeatedly and almost instantly changeable. The adjusting mechanism involves no large exposed non-leather parts and particularly there are no non-leather parts in contact with the handgun.

This is achieved employing a holster having a body and a liner defining a handgun pouch and having a metal or similar reinforcing innerliner which defines the pouch more precisely to the contour of the handgun to be carried. Secured to the inner face of part of the reinforcement is an elongated spring having a free end. A screw or other fastener means extends through the outer body of the holster and engages the free end of the spring and the reinforcement whereby rotation of the screw in one direction deflects the spring inward into the body cavity, rotation in the opposite direction returns the spring to a position outside of the body cavity. In an alternate embodiment the spring is an integral part of the reinforcement member.

BRIEF DESCRIPTION OF THE DRAWINGS

This invention may be more clearly understood from the following detailed description and by reference to the drawings in which:

FIG. 1 is a side elevational view of a holster incorporating this invention;

FIG. 2 is a front elevational view thereof;

FIGS. 3 and 4 are top views thereof;

FIG. 5 is a vertical section through the holster of FIG. 1 taken along lines 5—5 of FIGS. 1 and 2;

FIG. 6 is a vertical section similar to FIG. 5 taken with the holster adjusted to its maximum resistance to drawing;

DETAILED DESCRIPTION OF THE INVENTION

Figure 7:
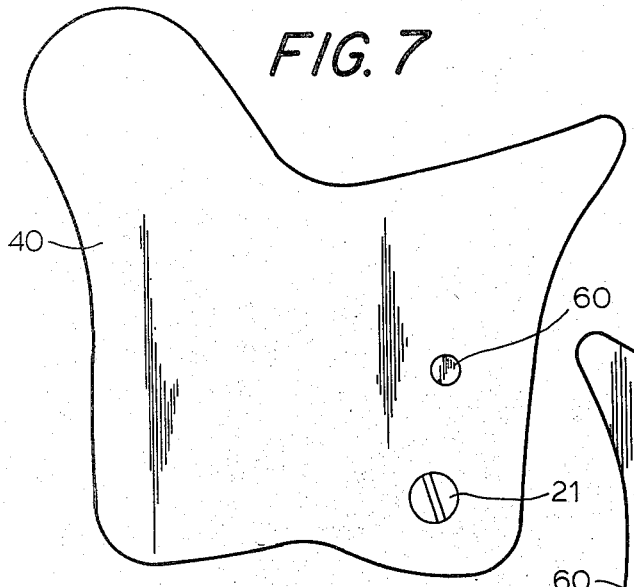
FIGS. 7 and 8 are front and rear face views respectively of the metal reinforcement blanks employed in this invention.

Now referring to FIGS. 1 and 2 a holster 10 which for all intents and purposes appears from the exterior to be a conventional high ride holster with an integral belt loop 11, a sight channel 12 and an enlarged upper outer face portion 13 which serves to enclose the trigger and trigger-guard region of the weapon to be carried. A typical application for such a holster is to carry a Colt 45 caliber Government model semiautomatic pistol. Other hand guns may be carried in this or similar holsters with the particular configuration of a holster tailored to the weapon to be carried. As may be seen more clearly in FIG. 2 the holster body is formed from a single piece of leather or leather-like material 14 having a fold 15 at the front and with two rear edges brought together at a welt 15 at the rear of the holster. The holster body 14 includes the integral belt loop portion 11 secured by two or more fasteners 20 and 21 to the holster body. Belt loop portion 14 defines a belt loop 22 between the holster body and the portion 11. The belt loop portion 11 typically includes a pair of wings 23 and 24 best seen in FIG. 1 contoured to fit the hip region of the wearer. The wings 23 and 24 and the belt loop portion 11 may be stiffened by an internal stiffener located between the thicknesses of the body portion 14 which actually defines the inner layer of the belt loop and the liner 25 of the holster which defines the outer surface of the belt loop portion 11 in the final assembly. The holster in accordance with this invention is lined or at least the adjustment feature described below is covered.

The relationship of each of these portions and in particular the sight channel 12 may be clearly seen in FIG. 3 in which the holster is viewed directly above from directly above. It may be noted that the handgun cavity 30 defined by the holster body 14 is slightly tapered downward to accommodate a handgun with increasing frictional engagement as the handgun is holstered. This allows a shooter to easily insert the handgun and drive it home to the degree of resistance which he desires and then upon drawing must overcome that same frictional resistance. The broad belt loop including wings 23 and 24 tend to stabilize the holster on the belt and prevent its riding up during drawing.

It is recognized that with wearing of such a holster the leather-like material body would tend to develop a configuration of the handgun and the resistance to drawing would normally change with use. The weapon will be held less securely and may if other precautions are not taken be allowed to fall out. This is prevented through the addition of the reinforcing member which is configured to the shape of the handgun to be carried and is located between the holster body 14 and the liner 25. Holsters of this type are sometimes referred to as metal lined holsters although there is no metal lining in contact with the handgun. The metal lining preferably sheet steel of 0.020" thickness and formed into a modified U-shape about a vertical axis to define the precise shape of the holster as shown in FIGS. 3 and 4. The inner liner 25 protects the handgun from contact with the metal reinforcement which is shown in FIGS. 5 and 6 in section and in more detail in FIGS. 7–11. The inside dimension of the reinforcement member is determined by the size and shape of the handgun to be carried adjusted by the thickness of the liner 25 and the desired clearance. The presence of the internal reinforcement within the holster shown in FIGS. 1, 2 and 3 results in the very precise shape shown in these figures and one which is not subject to change with age or use of the holster because the reinforcement presents a relatively rigid shape resisting deformation. This is particularly true because the reinforcement member includes a sight channel 12 which tends to reinforce and stiffen the metal reinforcement plate. In certain embodiments the reinforcement plate may extend to the rear to the extent that its ends are secured to the welt as by screws extending therethrough. As an example of a holster employing a welt member which secures body reinforcing springs together see our co-pending application, Ser. No. 11,418 filed Feb. 12, 1979.

Incorporating our invention as disclosed into a reinforced holster of the type shown in FIGS. 1 through 3 a significant change in the handgun cavity results. Again referring to FIG. 4, the improvement may be easily seen for looking down into the end gun cavity the inner wall adjacent to the belt loop is shown to have a definite inward bulge thereby reducing the overall width of the handgun cavity. This bulge involves a smooth transistion of a liner 25 over a major portion of the bottom region of the handgun cavity. This bulge 35 is shown in its maximum extent or size whereby the handgun cavity is the smallest and one which securely holds the hand gun by side pressure against the reinforced outer wall of the holster. FIG. 4 shows the same holster as FIG. 3 with the adjustment feature of this invention fully adjusted inward against the side of the frame or slide of the handgun contained therein. It is also noteable in FIG. 4 that no metal is exposed within the handgun cavity. The bulge 35, as will hereinafter be explained is continuously adjustable from zero height as shown in FIG. 3 to the maximum height of FIG. 4. And this is adjustable simply by the user using a screw driver or a coin to tighten the single adjusting screw shown in FIGS. 5 and 6.

The details of the reinforcement and adjusting features may be more clearly understood by reference to FIG. 5 which is a vertical section through the holster along lines 5—5 of FIGS. 1 and 2. In FIG. 5 the outer body 14 and the liner 25 are shown to embrace the body reinforcement member 40 which actually defines the entire handgun cavity. The reinforcement member 40 is precut to the shape shown in FIG. 7 for this type of holster and is formed with the leather to the final form including the sight channel 12. In this case the body 14, liner 25 and welt 15 are shown secured together by a stitch line 41, one stitch of which appears in FIG. 5. The reinforcement member 40 does not extend to the stitch line. Visible in FIG. 5 is a spring member 50 on the inner face of the reinforcement member 40 in the region preferably adjacent to the side of the handgun cavity 30. Secured to the reinforcement member 40 adjacent to the spring 50 is a threaded collar 51 which is engaged by the threads of screw 21. It is therefore apparent that screw 21 may provide multiple functions of securing the belt loop flap 11 to the holster body and also adjustment of the spring member 50. The end of the threaded portion of screw 21 extends through the threaded collar 51 and then into engagement with the adjacent side of spring 50.

The effect of tightening screw 21 is also illustrated in FIG. 6 which corresponds to FIG. 5 with screw 21 and its inner most position. In such case the screw extends significantly through the threaded collar 51 which is shown in section FIG. 6 and depresses the inner end of spring 50 inwardly. This inward movement of spring 50 forces the liner 25 inward to produce the bulge 35 of FIG. 4. Since the screw adjustment is used, the size of bulge 35 is continuously adjustable. Also, since the spring member 50 normally lies against the inner face of reinformement member 40 with the screw 21 adjusted outward as shown in FIGS. 4 and 5, the spring 50 has a negligible effect upon the size of the body cavity when it is so desired.

Figure 8:
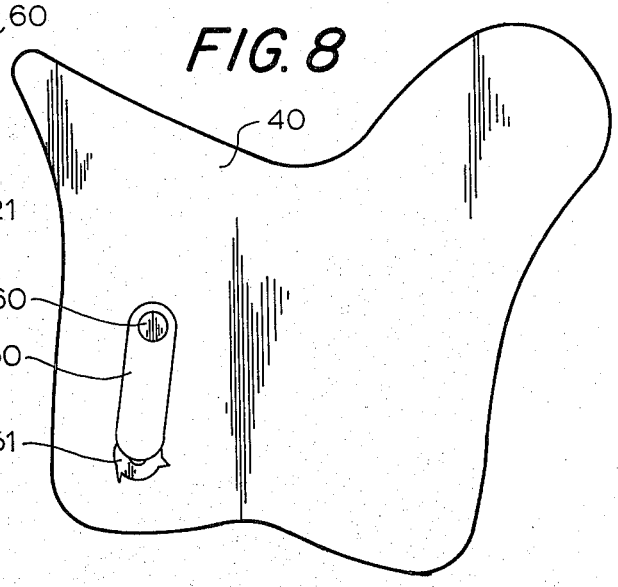
Figure 9:
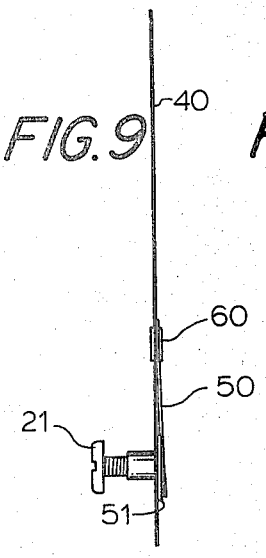
FIGS. 9 and 10 are fragmentary edge elevational views of the blanks of FIGS. 7 and 8.

The accomplishment of these features is achieved with the relatively simple structure illustrated in FIG. 7 through 9 showing the reinforcement 40 prior to formation into the complex shape which defines the body cavity. Starting with a flat blank the reinforcement member 40 appears with its outer face showing in FIG. 7 and its inner face appearing in FIG. 8. In FIG. 8 the rivet 60 is shown securing one end of leaf spring 50 to the reinforcement plate 40 while the threaded collar 51 is shown adjacent to the free end of spring 50.

Figure 10:
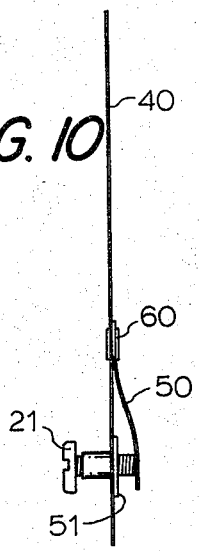

The co-action of these metal members is best seen in FIGS. 9 and 10 wherein FIG. 9 shows the screw 21 fully backed off and the spring 50 lying virtually flat against the collar 51. Thus the overall thickness of the assembly to the right from the drawing or towards the interior of the finished holster is virtually unchanged from the reinforcement member alone.

In FIG. 10 screw 21 has been tightened and its threaded end has deflected spring 50 in a distance delta ($\Delta$) beyond the plane of the plate 40. This distance delta ($\Delta$) constitutes the adjustment made.

Figure 11:
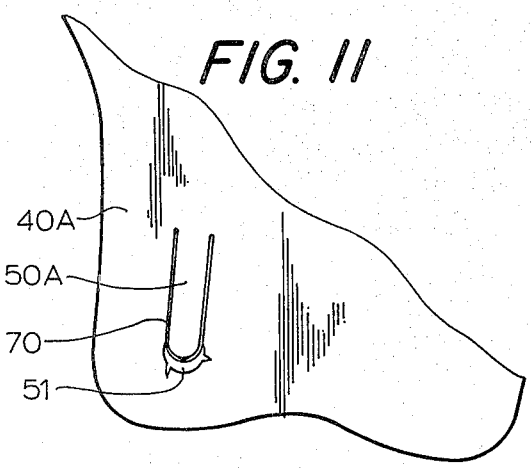
FIG. 11 is a fragmentary view of an alternate embodiment of this invention.

FIG. 11 is a fragmentary view of an alternate form of spring of reinforcement plate 40A employing an integral spring finger 50A. This spring finger 50A is formed by the stamping of a U-shaped slot 70 in plate 40A. The collar 51 similar to that employed in each of the previous figures and an adjusting screw unshown in FIG. 11 is employed. This embodiment offers a degree of the simplicity in the elimination of the rivet 60 while providing fully adequate spring adjustement.

It may therefore be seen that employing this invention any conventional holster may be converted to a controllable drag or resistance to drawing holster.

Figure 12:
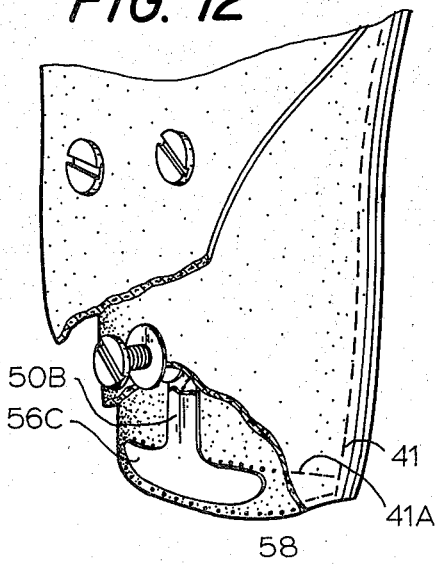
FIG. 12 is a fragmentary perspective view of another alternate embodiment of this invention.

In the preferred embodiment of this invention we have used a reinforcing member 40 throughout providing precise sizing in the handgun cavity as illustrated in FIGS. 3 through 6. It is, however, within the scope of this invention no reinforcing member 40 be used but rather the spring 50 secured some point which may be provided by the leather itself be as a base for deflection of the spring 50 inward. We have found that such a system is operative in providing a better degree of adjustable resistance than prior art holsters, however, for optimum and preferred embodiments the reinforcing member is recommended. Such an alternate embodiment is shown in the framentary sectional view of FIG. 12. In such case, the spring 50A may be secured at one enlarged end 50B held by stitching to the unlined holster body by two lines of stitching, the primary stitch line 41 plus an interrupted stitch line 41A. Since the holster of FIG. 12 is unlined it is desirable that spring 50A be protected from damaging the finish of the handgun. This is accomplished by a coating of resilient nonmarring material such as a coating 58 of vinyl or similar plastic.

The above described embodiments of this invention are merely descriptive of its principles and are not to be considered limiting. The scope of this invention instead shall be determined from the scope of the following claims, including their equivalents.

We claim:

1. A controllable resistance to draw holster comprising:

(a) a holster body comprising a piece of leather or leather-like material formed to define a handgun carrying cavity;

(b) movable means positioned within said handgun cavity; and (c) control means for selectively moving said movable means to a greater or lesser extent into said handgun cavity to change the size thereof;

(d) said movable means including a portion bearing against a handgun positioned in said cavity;

(e) said control means being operable by the user to vary the resistance to movement of the handgun in the holster;

(f) wherein said movable means comprises a spring deflectable into said handgun cavity by said control means;

(g) wherein said spring is a leaf spring with one portion secured within said holster body and at least one free portion movable into said handgun cavity responsive to operation of said control means.

2. The combination in accordance with claim 1 wherein said secured portion of said spring is held by stitching to said holster body.

3. The combination in accordance with claim 2 wherein said holster includes a pair of stitch lines partially surrounding the secured portion of said spring to hold said spring in position.

4. The combination in accordance with claim 3 wherein said spring includes an enlarged end region secured by said stitch lines.

5. A controllable resistance to draw holster comprising:

(a) a holster body comprising a piece of leather or leather-like material formed to define a handgun carrying cavity;

(b) reinforcement means of greater resistance to deflection than said holster body and located on the inner side of the piece of leather or leather-like material;

(c) spring means secured to said reinforcement means and including at least one free end;

(d) said free end of spring means extendable inwardly toward said handgun cavity; and (e) adjusting means engaging free end of said spring to controllably deflect said spring means to reduce the size of said handgun cavity at least locally.

6. The combination in accordance with claim 5 wherein said adjusting means comprises a screw engaging said spring means and movable with respect to said holster body to deflect said spring means upon the tightening of said screw.

7. The combination in accordance with claim 5 wherein said screw has a head located outside of the holster body whereby adjustments may be made from the exterior thereof.

8. The combination in accordance with claim 5 wherein said spring means is a leaf spring.

9. The combination in accordance with claim 5 wherein said reinforcement means defines at least a portion of the shape of said handgun cavity.

10. The combination in accordance with claim 9 wherein said reinforcement means positions said spring means to engage the side of a handgun when located within the handgun cavity.

11. A controllable resistance to draw holster comprising:

(a) a holster body comprising a piece of leather or leather-like material formed to define a handgun carrying cavity;

(b) a liner for said body of leather or leather-like material;

(c) reinforcement means of greater resistance to deflection than said holster body and liner combined defining the shape of the handgun cavity;

(d) said reinforcement means located between said holster body and said liner;

(e) spring means secured to said reinforcement and including at least one free end;

(f) said free end extendable into said handgun cavity;

(g) adjusting means engaging the free end of said spring controllably deflecting said spring member toward the handgun cavity to locally reduce the size thereof;

(h) said free end being positioned to deflect said liner inward in a local area to provide local frictional pressure upon a handgun contained within said holster.

12. The combination in accordance with claim 11 wherein said adjusting means comprises a screw engaging said reinforcing means and said spring.

* * * * *